US012196517B1

(12) United States Patent
Kasper et al.

(10) Patent No.: US 12,196,517 B1
(45) Date of Patent: Jan. 14, 2025

(54) CHARGING HANDLE ASSEMBLY FOR A FIREARM

(71) Applicant: Critical Objectives, LLC, Grand Haven, MI (US)

(72) Inventors: Eric Kasper, Grand Haven, MI (US); Timothy Kurtz, Spring Lake, MI (US)

(73) Assignee: Critical Objectives, LLC, Grand Haven, MI (US)

( * ) Notice: Subject to any disclaimer, the term of this patent is extended or adjusted under 35 U.S.C. 154(b) by 0 days.

(21) Appl. No.: 18/216,634

(22) Filed: Jun. 30, 2023

(51) Int. Cl.
*F41A 3/72* (2006.01)

(52) U.S. Cl.
CPC ..... *F41A 3/72* (2013.01)

(58) Field of Classification Search
CPC ..... F41A 3/72
USPC ..... 89/1.4
See application file for complete search history.

(56) References Cited

U.S. PATENT DOCUMENTS

| | | | | |
|---|---|---|---|---|
| 7,231,861 | B1 | 6/2007 | Gauny et al. | |
| D636,043 | S | 4/2011 | Olsen et al. | |
| 8,156,854 | B2 | 4/2012 | Brown | |
| 9,310,146 | B2 | 4/2016 | Gibbens | |
| 10,393,456 | B1 | 8/2019 | Beardsley | |
| 10,598,451 | B1 * | 3/2020 | Haidu | F41A 3/72 |
| 11,473,863 | B2 | 10/2022 | Rolf | |
| 2020/0080802 | A1 * | 3/2020 | Jennings | F41A 3/72 |
| 2021/0180896 | A1 | 6/2021 | Noonan et al. | |
| 2022/0341688 | A1 | 10/2022 | Kastrun et al. | |

* cited by examiner

*Primary Examiner* — Reginald S Tillman, Jr.
(74) *Attorney, Agent, or Firm* — Varnum LLP

(57) ABSTRACT

A charging handle assembly and handguard for Armalite (AR) style rifles or other similarly designed firearms is provided. The charging handle assembly includes at least one charging handle, at least one charging handle plate, and charging rod. The charging handle assembly is designed such that it is repositioned to a location, within the handguard, in front of the bolt carrier group of the firearm. More specifically, the repositioned charging handle assembly operates in a non-reciprocating fashion. When the user transitions the charging handle assembly from a first position to a second position, i.e., pulls the charging handle in a first or rearward direction within an elongated receiving slot in the hand guard, the charging rod pushes a front end of the bolt carrier group in the first direction thereby compressing the spring, such that the spring launches the bolt carrier group into a charged position thereby charging the firearm.

19 Claims, 11 Drawing Sheets

CHARGING HANDLE ASSEMBLY FOR A FIREARM

TECHNICAL FIELD

The present disclosure generally relates to firearms, and more particularly to modifications to upper receiver components including a repositioned charging handle assembly and railed handguard for receipt of the repositioned charging handle for Armalite (AR) style rifles or other similarly designed firearms.

BACKGROUND

Typically, the upper assembly of an AR style rifle or other similarly designed firearm comprises the upper receiver, the barrel, bolt carrier group, gas key, charging handle, charging rod, handguard, and other components necessary for the firearm to function. For example, the bolt carrier group houses the bolt, which extracts, rejects, and loads cartridges. The bolt works in conjunction with the gas key, attached to the bolt carrier group, which transfers gas from the fired cartridge to the bolt carrier group to cycle the action of the rifle. The charging handle assembly includes a charging rod coupled to a handle design and is an essential component used to pull the bolt carrier group to the rear, enabling the user to load and unload cartridges into the chamber of the barrel. Once a round is inserted, the charging handle is released, causing the bolt carrier group to move in a forward direction and chamber the round, resetting the firing mechanism.

Traditional charging assemblies position the charging handle on the top of the firearm, toward the rear of the upper receiver near the buttstock and utilize a reciprocating charging handle design. This configuration entails direct engagement of the charging handle assembly with the bolt carrier group, causing it to move in a back-and-forth motion with the bolt carrier group during firing.

However, this conventional type of charging handle assembly and its placement prove undesirable for users during operation of the firearm for multiple reasons. First, charging handle assemblies that are provided behind the bolt carrier group require the user to lower the firearm from his or her shoulder in a direction away from the intended target in order to attain proper and safe positioning to actuate the charging handle from the rear of the receiver. As a result of making these required movements, the user's concentration and control may be negatively affected, and valuable time impacted. Secondly, the charging handle assembly may be designed specifically for either left-handed or right-handed users and cannot be easily operated by the other hand. Third, when a user operates a firearm with a reciprocating charging handle design, the handle cycles with the bolt carrier group, to which it is attached. In other words, the charging handle moves in a rearward direction when the bolt carrier group moves rearward to eject a spent cartridge and load a new cartridge and, the charging handle then moves in a forward direction when the bolt carrier group moves forward to chamber the new cartridge. As such, the user must take care to avoid placing their hand in the path of the charging handle.

In addition, a conventional reciprocating charging handle design makes it more difficult to use optics, as the bolt carrier group's back-and-forth motion during firing can potentially interfere with the user's line of sight. Lastly, when user-installed accessories such as optics are mounted on the firearm, users face difficultly in reaching the traditional charging handle, compounding the challenges of operating the firearm.

As such, there is a need for an upper assembly with a repositioned charging handle, wherein the system allows for the ambidextrous, forward, non-reciprocating charging of the firearm. Furthermore, there is a need for a corresponding railed handguard that allows for the receipt of the repositioned charging handle and for easy attachment and accessibility of accessories to the rail system of the handguard.

BRIEF SUMMARY OF THE INVENTION

The present disclosure is directed to a firearm having a repositioned charging handle assembly and railed handguard for receipt of the repositioned charging handle. According to one embodiment of the invention, the firearm may generally comprise a handguard and a charging system. The handguard may comprise a first end, a second end, and an elongated handguard bore that extends from the first end to the second end defining a longitudinal length of the handguard. The handguard further defines an elongated receiving slot having a top engagement portion and a bottom engagement portion.

The charging system may comprise a bolt carrier group, a spring, a buffer, a charging rod, and a charging handle assembly. The bolt carrier group may have a front end and a rear end with the rear end thereof engaged with the buffer and the front end thereof engaged with the charging rod. The spring and the buffer may be housed in a buffering tube, such that the buffer is disposed between the bolt carrier group and the spring. The charging rod may be disposed in the handguard bore and engaged with the front end of the bolt carrier group.

The charging handle assembly may be coupled to the charging rod and engaged with the elongated receiving slot, and may further comprise at least one charging handle and at least one charging plate disposed between and operatively coupled to the charging handle and the charging rod.

The charging handle assembly and the charging rod may be movable between a first position and a second position, such that when the charging handle assembly is moved in a first direction within the elongated receiving slot the charging rod pushes the front end of the bolt carrier group in the first direction thereby compressing the spring, such that the spring launches the bolt carrier group into a charged position thereby charging the firearm.

The present disclosure further provides a method of assembling the firearm. The method may comprise the following steps: inserting the charging rod into a charging rod slot defined by the elongated handguard bore, such that the charging rod body is slidably received by the charging rod slot of the elongated handguard bore at the first end of the handguard; and inserting the charging handle assembly into a takedown portion of the elongated receiving slot such that a top track of the charging handle assembly slidably engages the top engagement portion of the elongated receiving slot and the bottom track of the charging handle assembly slidably engages a bottom engagement portion of the elongated receiving slot; aligning the charging handle assembly at the charging handle plate with the charging rod cavity of the charging rod, such that the first portion of the charging handle plate engages the charging rod cavity; slidably moving the charging handle assembly in a first direction from the takedown portion along the elongated receiving slot; and inserting a bolt carrier group.

BRIEF DESCRIPTION OF THE DRAWINGS

The embodiments set forth in the drawings are illustrative and exemplary in nature and not intended to limit the subject matter. The following detailed description of the illustrative embodiments can be understood when read in conjunction with the following drawings, where like structure is indicated with like reference numerals and in which.

DETAILED DESCRIPTION OF THE INVENTION

Figure 1:
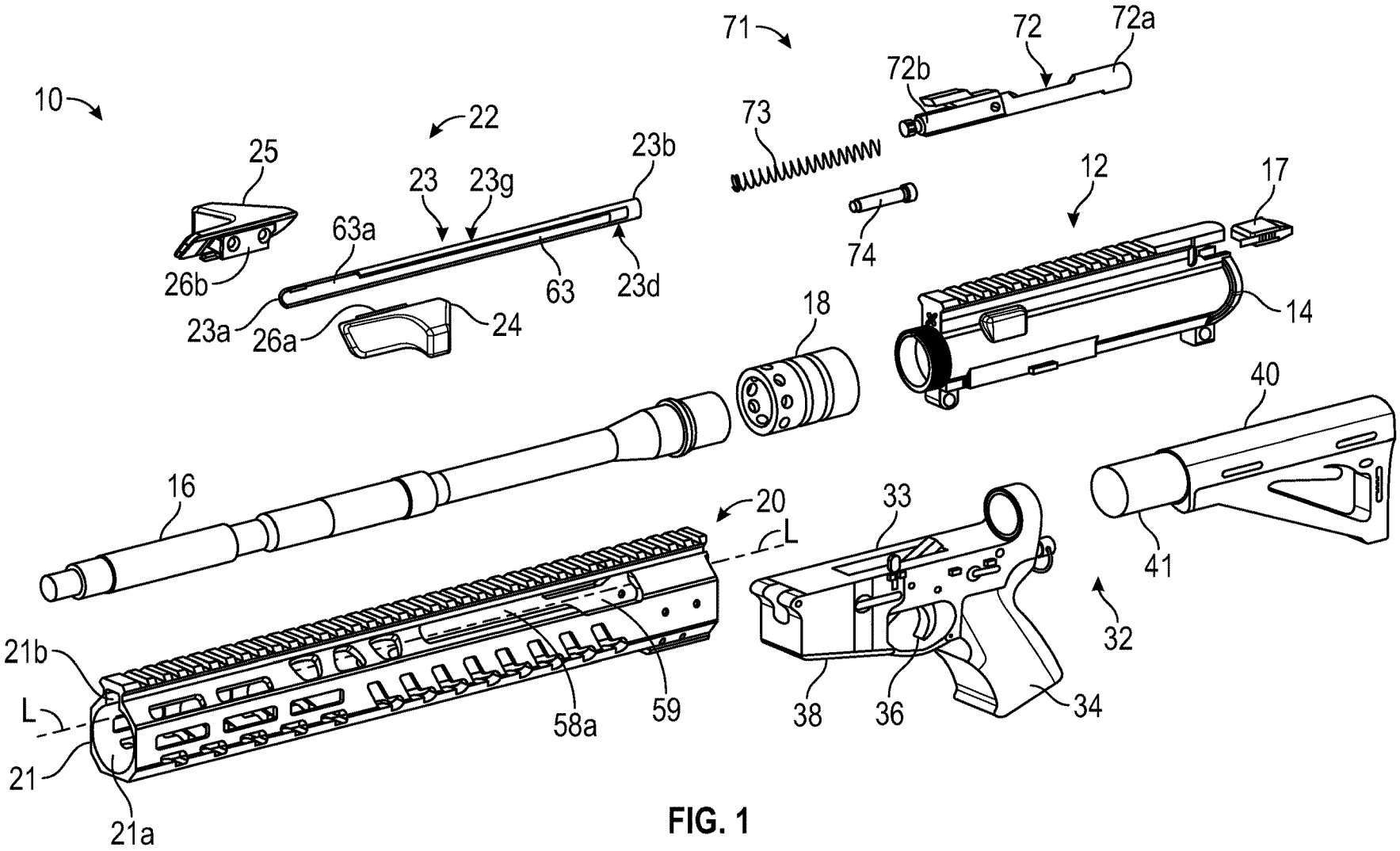
FIG. 1 is a partially exploded view of an exemplary firearm including an illustrative charging handle assembly, charging rod, and a railed handguard in accordance with the present disclosure.

While the present disclosure may be described with respect to specific applications or industries, those skilled in the art will recognize the broader applicability of the disclosure.

Those having ordinary skill in the art will recognize the terms such as "a", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims. Any numerical designations, such as "first" or "second" are illustrative only and are not intended to limit the scope of the disclosure in any way.

The following discussion and accompanying figures disclose upper assembly components for Armalite (AR) style rifles or other similarly designed firearms including an upper receiver, a repositioned charging handle assembly comprising charging handles, charging handle plates, charging rod, and a railed handguard for receipt of the repositioned charging handle assembly. It is contemplated that the components described herein related to the upper assembly, including the upper receiver, repositioned charging handle components and railed handguard, may be formed of the same materials, different materials, or a combination thereof. The upper assembly components may be formed of metallic materials, alloys, polymeric materials, glasses, composites, and the like or combinations thereof. For example, the metallic materials may be selected from aluminum, steel, carbon steel, stainless steel, zinc, magnesium, copper, iron, and the like or combinations thereof. The alloys may be selected from aluminum alloy, titanium alloy, magnesium alloy, copper alloy, and the like or combinations thereof. The polymeric materials may be selected from thermoset polymers (such as epoxy, resin, polyurethane, silicone, and the like or combinations thereof), thermoplastic polymers (such as polyamide, polycarbonate, polyethylene, and the like or combinations thereof), and the like or combinations thereof. The glasses may be selected from fiberglass, carbon fiber, aramid fiber, and the like or combinations thereof.

Furthermore, the upper assembly components may be formed by injection molding, extrusion, pultrusion, die casting, milling, drilling, soldering, stamping, machining, or otherwise manufactured using common methods known to individuals skilled in the relevant art. The upper assembly components may also be subject to other processing steps such as power coating, sand blasting, plating, staining, painting, anodizing, polishing, or otherwise finished and/or treated using common methods known to individuals skilled in the relevant art. The above examples are not intended to be limiting in any matter, as it will be understood that the materials and/or methods used to form the upper assembly components may vary based on the type and intended application or operation of the firearm on which such components are installed.

In a general sense, the charging handle assembly of the present disclosure is designed such that it is repositioned to a location, within the handguard, in front of the bolt carrier group of a firearm. More specifically, the repositioned charging handle assembly operates in a non-reciprocating fashion. When the user transitions the charging handle assembly from a first position to a second position, i.e., pulls the charging handle to a first or rearward direction within the elongated receiving slot, the charging rod pushes the front end of the bolt carrier group in the first direction thereby compressing the spring, such that the spring launches the bolt carrier group into a charged position thereby charging the firearm.

The charging handle does not move between the first and second positions with the bolt carrier group, the non-reciprocating charging handle allows the user to keep their hand on the handguard while charging the firearm, which can improve accuracy and control. In addition, the forward placement of the charging handle assembly on the handguard of the upper assembly enables the user to check the chamber and charge or recharge the firearm without lowering the same from his or her shoulder. Furthermore, displacement of the charging handle to a position in front of the bolt carrier group distances the charging handle from user-installed accessories such as optics. As such, the user is easily able to actuate the charging handle with one of his or her left or right hand while the firearm is shouldered and without impediment of accessories.

Figure 9A:
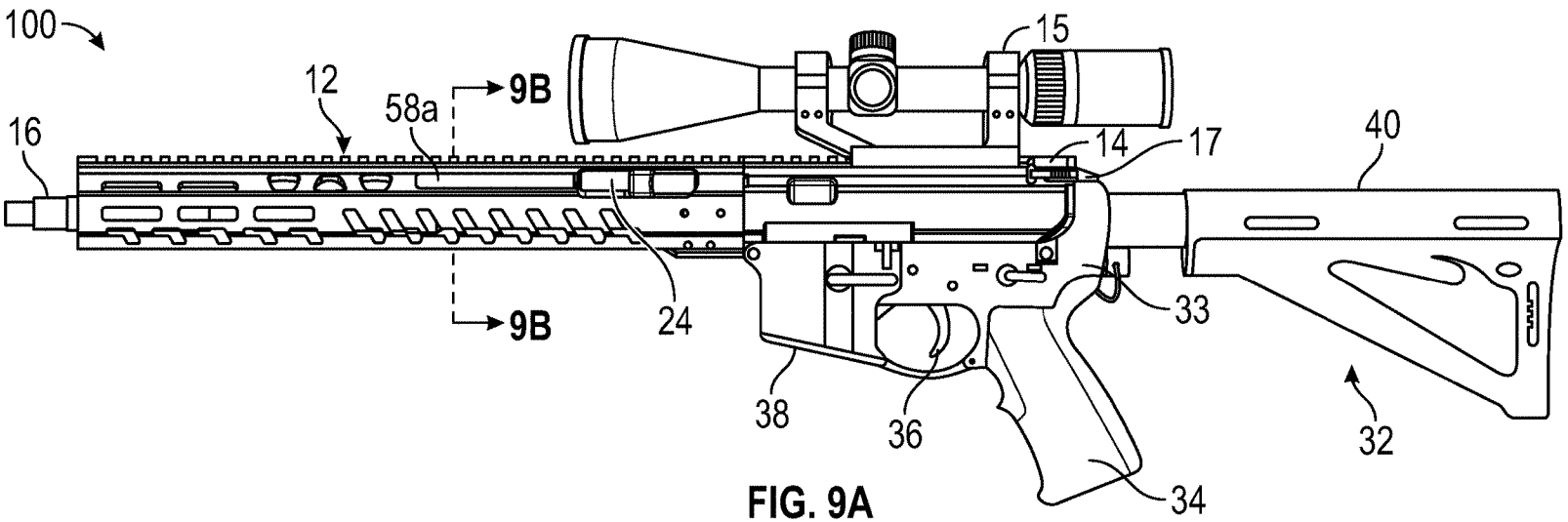
FIG. 9A is a side view of the illustrative charging handle assembly and a railed handguard in accordance with the present disclosure as shown on an exemplary assembled firearm complete with optical scope.

More particularly, referring now to the drawings, wherein like reference numerals refer to like components, FIGS. 1 and 9A generally show a firearm 10, 100 in an exemplary embodiment, including selected components thereof, such as an upper receiver portion 12, lower receiver portion 32, a buttstock 40, barrel 16, barrel nut 18, handguard 20, and charging handle assembly 22, 122. Although the repositioned charging handle assembly 22, 122 and railed handguard 20 are illustrated in the figures as part of an AR-15 style rifle, it should be appreciated that the repositioned charging handle assembly 22, 122 and corresponding railed handguard 20 of the present disclosure may be applicable to a variety of types of similarly designed firearms to the AR-15 platform without departing from the nature of the present disclosure. For example, the firearm 10, 100 may be of the AR-15/M16 platform of firearms, which may include the AR-10, AR-15, M16, M16A1, M16A2, M16A3, M16A4, CAR-15, M4, M4A1, and the like.

Figure 7:
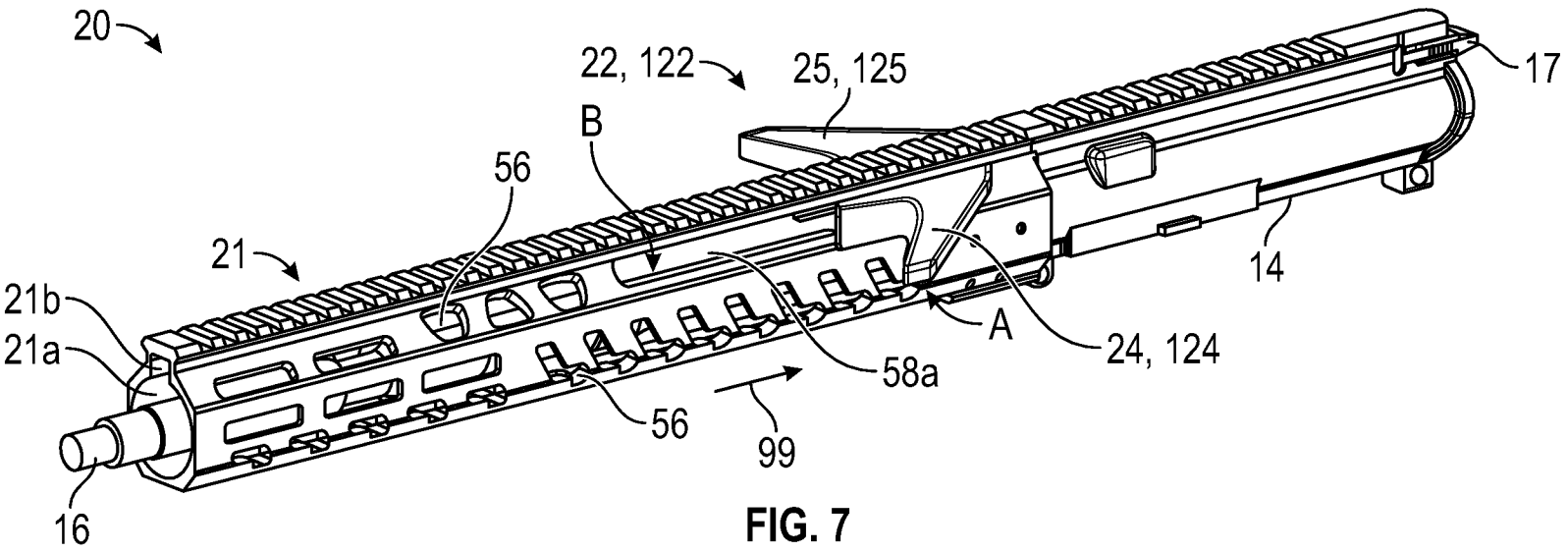
FIG. 7 is a perspective partially assembled view of an exemplary upper assembly including the illustrative upper receiver, barrel, charging handle assembly, and railed handguard in accordance with the present disclosure.
Figure 8:
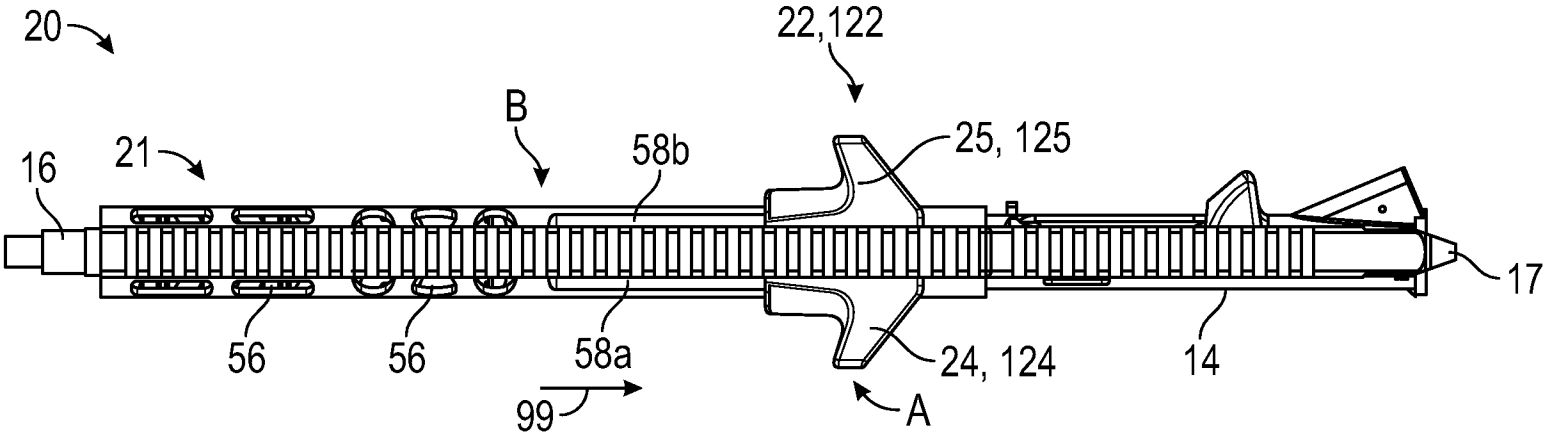
FIG. 8 is a top partially assembled view of the exemplary upper assembly including the illustrative upper receiver, barrel, charging handle assembly, and railed handguard in accordance with the present disclosure.

Turning first to an exemplary upper receiver portion 12, the upper receiver portion 12 as shown in the firearm 10, 100 of FIGS. 1 and 9A, and in FIGS. 7 and 8 alone, may include an upper receiver body 14. The upper receiver body 14 may be coupled to the lower receiver portion 32 and the buttstock 40. Moreover, the upper receiver portion 12 may be operatively coupled to a barrel 16 via a barrel nut 18 (FIG. 1). A portion of the length of the barrel 16 may be housed within the railed handguard 20 of the present disclosure, as shown in FIGS. 7 and 8, in the assembled firearm 100 of FIG. 9A. The barrel 16 extends from the upper receiver body 14 through the handguard bore 21*a* of the tubular handguard body 21.

More specifically, the railed handguard 20 comprises a tubular handguard body 21 extending from a first end 42*a* to a second end 42*b* and defining a longitudinal length L of the handguard. The tubular handguard body 21 further defines an elongated handguard bore 21*a* that extends between the first end 42*a* and the second end 42*b*. The handguard further defines a charging rod slot 21*b* extending substantially parallel along the longitudinal length L of the railed handguard 20 and an elongated receiving slot 58*a*, 58*b* having a top engagement portion 60 and a bottom engagement portion 61.

The upper assembly may also include a charging system 71 comprising a bolt carrier group 72 having a front end 72*a* and a rear end 72*b*, a spring 73, a buffer 74, a charging rod 23, and a charging handle assembly 22, 122.

The buffer 74 is disposed between the bolt carrier group 72 and the spring 73 and the bolt carrier group rear end 72*b*, such that the bolt carrier group rear end 72*b* is operatively engaged with the buffer 74. The charging rod 23 is disposed in the handguard bore 21 and engaged with the front end of the bolt carrier group 72.

The charging handle assembly 22, 122 is thereby coupled to the charging rod 23 and engaged with the elongated receiving slot 58*a*, 58*b*. The charging handle assembly 22, 122 generally comprises at least one charging handle 24, 25;

124, 125 and at least one charging handle plate 26*a*, 26*b*; 126*a*, 126*b* disposed between and operatively coupled to the at least one charging handle 24, 25; 124, 125 and the charging rod 23.

As such, the charging handle assembly 22, 122 is disposed in front of the bolt carrier group 72 via the railed handguard 20. In this way, the charging handle assembly 22, 122 and the charging rod 23 are movable between a first position A and a second position B, such that when the charging handle assembly 22, 122 is moved in a first (rearward) direction 99 within the elongated receiving slot 58*a*, 58*b* the charging rod 23 pushes the front end of the bolt carrier group 72 in the first direction 99 thereby compressing the spring 73 such that the spring 73 launches the bolt carrier group 72 into a charged position thereby charging the firearm 10, 100.

A mud plug 17 may be inserted into the upper receiver body 14 at the open end portion thereof to prevent mud, dirt, and other debris from entering and impacting the firearm 10, 100.

The firearm 10, 100 further includes a lower assembly 32 coupled to the upper assembly, as shown in FIGS. 1 and 9A. The lower assembly 32 includes lower receiver 33, pistol grip 34, trigger mechanism 36, magazine slot 38 for receiving a magazine, buttstock 40, and all other conventional internal and/or external components that are a part of a standard lower assemblies of an AR style or similarly designed firearm not specifically mentioned herein but nonetheless required for operation and therefore considered a part of the lower assembly 32 of the present disclosure.

More specifically, as shown in FIG. 9A, the lower receiver 33 is coupled to pistol grip 34, for gripping by the user, which extends downwardly along the lower receiver 33 and houses the trigger mechanism 36, which ultimately initiates the firing of the firearm 10, 100. The magazine slot 38, receives a magazine which can be loaded with a plurality of rounds, and may detachably mount to the lower receiver 33. The buttstock 40 is coupled to and extends rearwardly from the lower receiver 33 of the firearm 10, 100 via the receiver extension 41, also known as the buffer tube (FIG. 1). The buttstock 40 is used to support the firearm 10, 100 against a shoulder of the user.

As such, it is understood that all of the components of the upper assembly and lower assembly 32 are operationally assembled together to produce a functional firearm 100. Furthermore, it is understood that not all of the components described herein must be present at all times. Said another way, the design of the firearm 10, 100 may deviate to exclude certain components not necessary for the intended function or application of the firearm and/or include additional components, for example, mounting elements such as laser sights, lights, optics, slings, and the like.

Figure 2A:
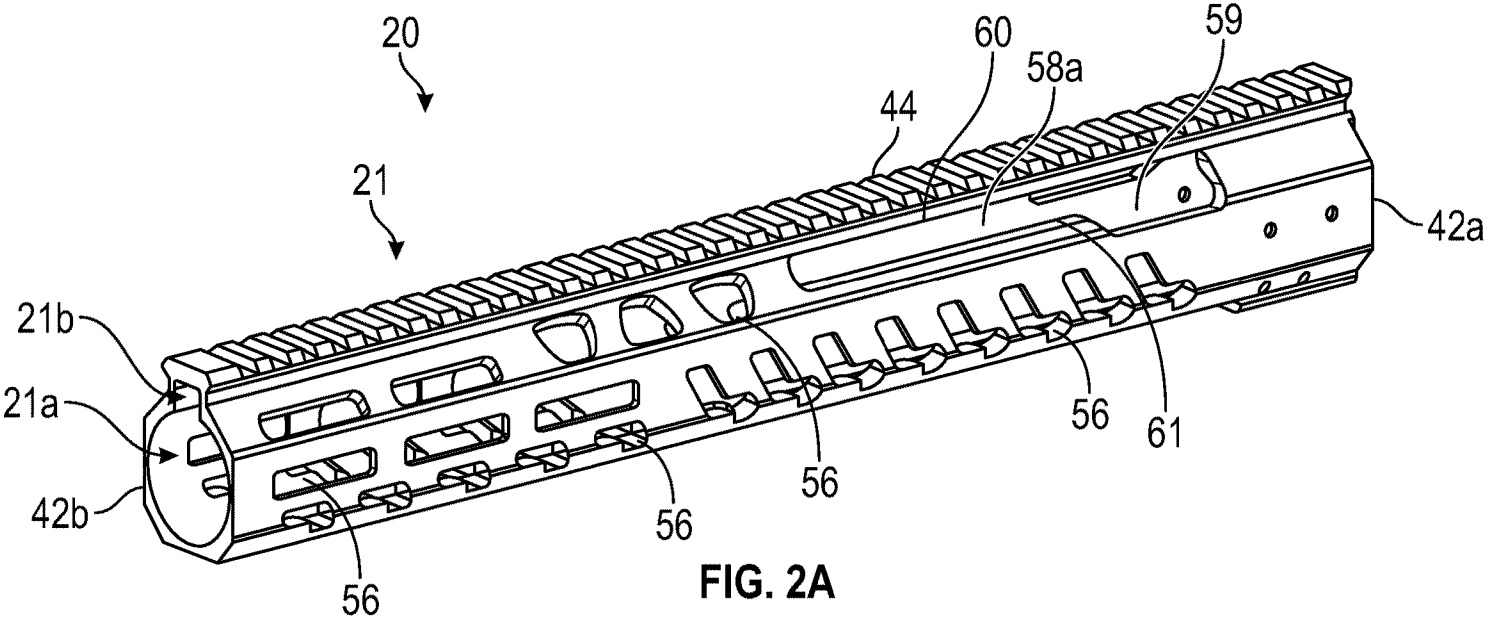
FIG. 2A is a perspective view of the illustrative railed handguard.

Now referring generally to FIGS. 2A-2F, the railed handguard 20 of the present disclosure is illustrated in more detail. The railed handguard 20 may function to protect the user's hand from heat generated by the firearm 10, 100, allow the attachment of accessories such as scopes, lights, and the like, and/or support the repositioned charging handle assembly 22, 122 of the present disclosure. More specifically, as shown in FIG. 2A, the railed handguard 20 may comprise a tubular handguard body 21 extending from a first end 42*a* to a second end 42*b*. The tubular body 21 of the railed handguard 20 may further comprise a top surface 44 (FIG. 2B), a bottom surface 46 (FIG. 2C), and two side surfaces 48, 50 (FIG. 2D), disposed between the top and bottom surfaces 44, 46. The top surface 44 may be substantially parallel to the bottom surface 46 along the entire longitudinal length L of the tubular body 21 of the railed handguard 20. Each of the top surface 44, bottom surface 46, and side surfaces 48, 50 extend from the first end 42*a* to the second end 42*b* of the tubular body 21 of the railed handguard 20, along the entire longitudinal length L thereof.

The tubular handguard body 21 defines an elongated tubular bore 21*a* therein that likewise extends from the first end 42*a* to the second end 42*b*. The handguard 20 further defines a charging rod slot 21*b* disposed proximate to a top surface of the handguard 20 and extends from the first end 42*a* of the handguard to the second end 42*b* of the handguard 20.

The elongated tubular bore 21*a* is configured to receive the barrel 16 and the charging rod slot 21*b* is configured to slidably receive the charging rod 23. The charging rod slot 21*b* and the handguard bore 21*a* collectively define an inner surface of the handguard 20.

Figure 2B:
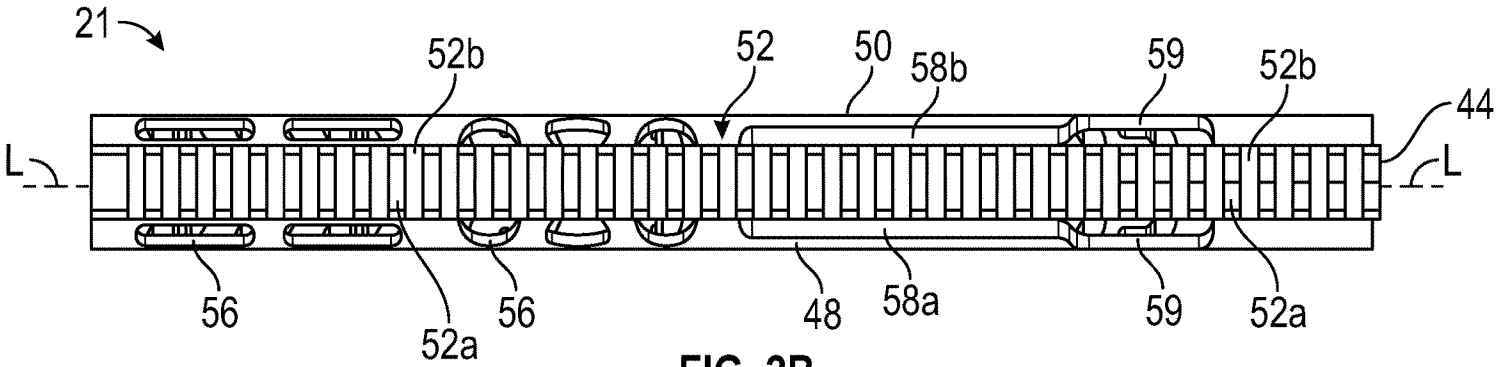
FIG. 2B is a top view of the illustrative railed handguard.
Figure 2C:
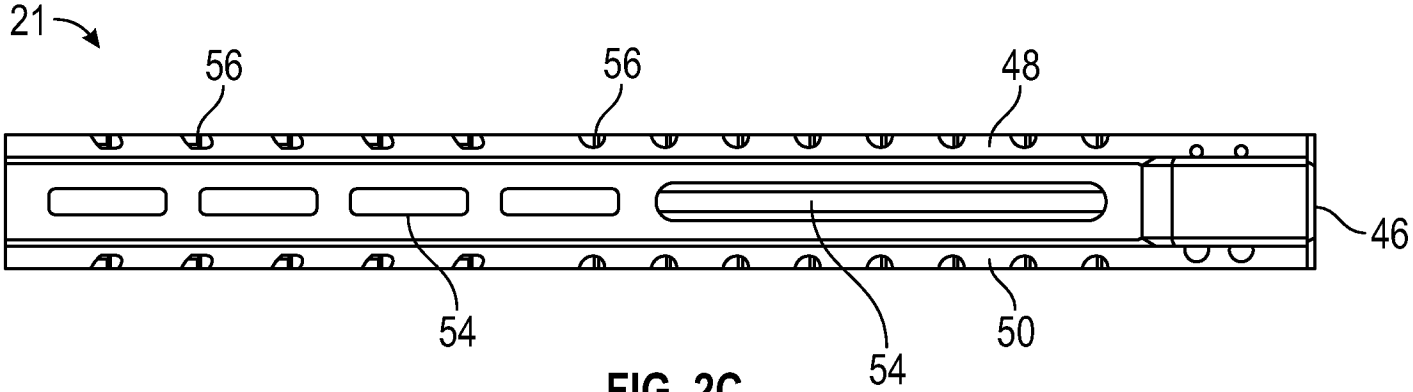
FIG. 2C is a bottom view of the illustrative railed handguard.
Figure 2D:
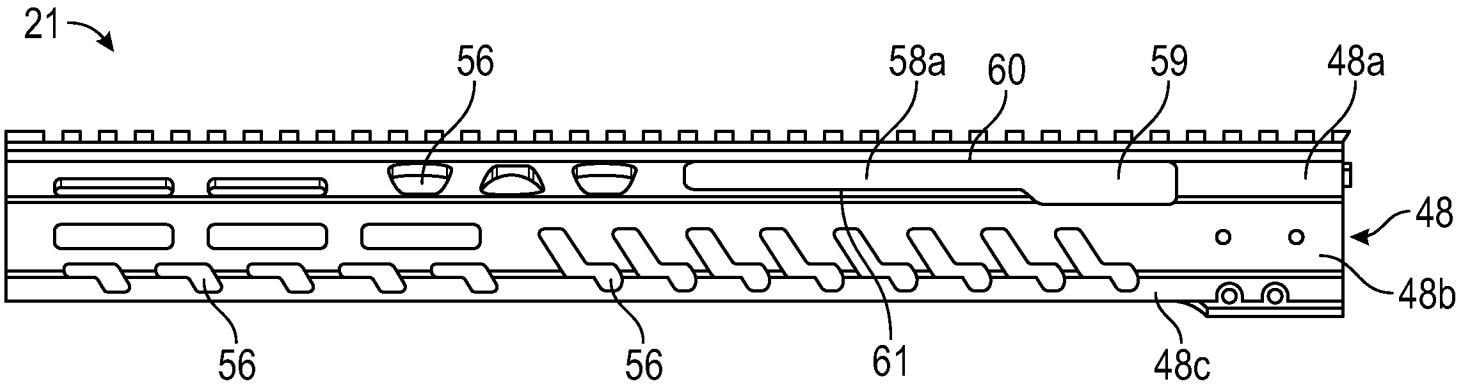
FIG. 2D is a side view of the illustrative railed handguard.
Figure 2E:
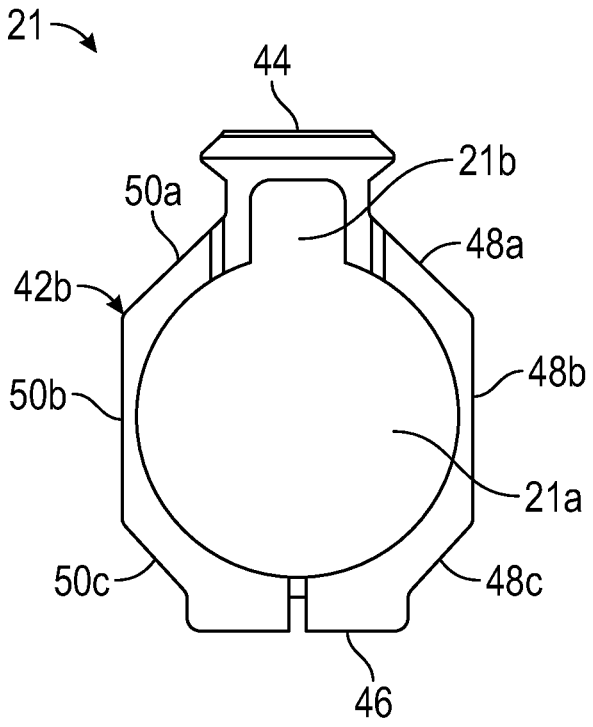
FIG. 2E is a front view of the illustrative railed handguard.
Figure 2F:
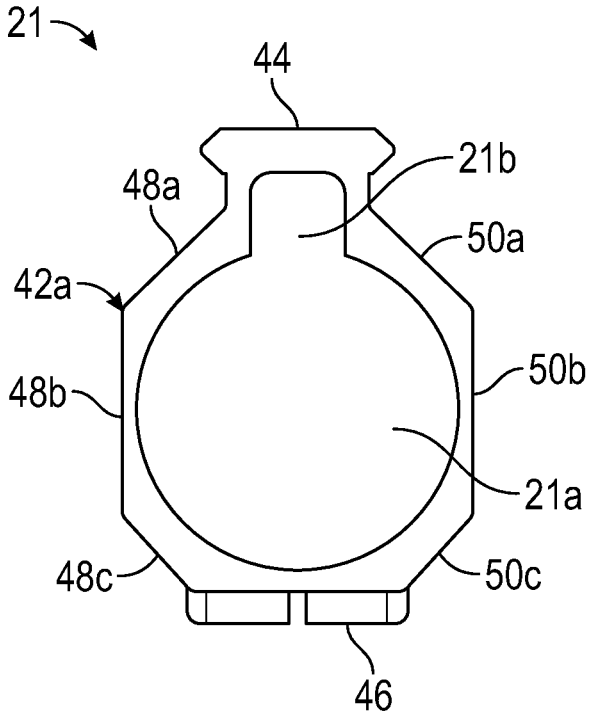
FIG. 2F is a rear view of the illustrative railed handguard.
Figure 9B:
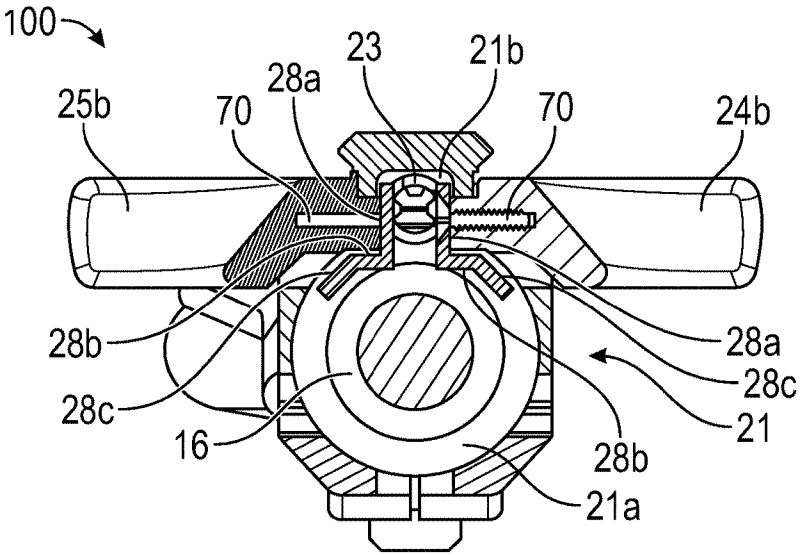
FIG. 9B is a cross-sectional view of the exemplary assembled firearm taken along line B-B in FIG. 9A.

In one exemplary embodiment, the tubular handguard body 21 may have a substantially octagonal shape (i.e., having eight sides) as further shown in FIGS. 2E, 2F and in FIG. 9B, which depicts a cross section of the tubular body 21 of the railed handguard 20 taken along line 9B-9B of FIG. 9A. It will be understood that the cross-sectional profile is not limited by the exemplary embodiments discussed herein and may therefore be circular, oval, square, rectangular or any other geometrical configuration suitable in view of the present teachings.

Still referring to FIGS. 2A-2D, the tubular body 21 of the railed handguard 20 may also include a plurality of apertures 54, 56. The plurality of apertures 54, 56 may function to reduce the amount of material used in the railed handguard 20, and therefore reduce the overall weight of the firearm 10, 100. Weight reduction may be beneficial for users who require a lighter firearm for mobility or case of use. The plurality of apertures 54, 56 may also function to improve heat dissipation and provide ventilation by allowing air to enter and circulate around the barrel 16 to facilitate barrel cooling. Heat dissipation will, in turn, keep the railed handguard 20 cooler and more comfortable for the user to handle. Alone or in combination with the above, the plurality of apertures 54, 56 may also provide an overall design aesthetic to the railed handguard 20 and/or the firearm 10, 100. The plurality of apertures 54, 56 may be of any geometric shape including, but not limited to, a circle, oval, triangle, rectangle, ellipse, square, rhombus, diamond, polygonal. L-shaped, slotted, elongated and/or any combination thereof or the like. The plurality of apertures 54, 56 may comprise a row of repeating patterns and/or geometric shapes. The plurality of apertures 54, 56 may be of various sizes, substantially identical in size, or a combination thereof. Furthermore, the number of apertures and placement may vary depending on the overall length of the railed handguard 20; for example, longer handguards 20 may require more apertures 54, 56 placed at locations spaced along the length of the tubular body 21 of the railed handguard 20 to aid in overall weight reduction of the firearm 10, 100, improved heat dissipation, and/or improved handling.

Turning now to the top surface 44 of the tubular body 21, as shown in more detail in FIG. 2B, the top surface 44 may include a rail system 52 comprising a plurality of substantially parallel and evenly spaced, squared-off ribs 52*a* and valleys 52*b* that run along the entire longitudinal length L of the tubular body 21 of the handguard 20. The ribs 52*a* and valleys 52*b* of the rail system 52 may be integrally formed into the handguard 20. For example, the ribs 52*a* and valleys 52*b* of the rail system 52 may be machined into the top surface 44 of the tubular body 21 of the handguard 20 during manufacturing of the same, thereby creating an integrated mounting interface. Typical rail systems comprising ribs 52*a* and valleys 52*b* are known in the industry as Picatinny rails or Weaver rails and provide a standardized system of slots and ribs that allow for secure and easy mounting of various user-installed accessories, such as scopes, lasers, foregrips, and the like.

Still referring to the top surface 44, as further shown in the front and rear views of the railed handguard 20 in FIGS. 2E and 2F respectively, and in the cross-sectional view of the upper receiver in FIG. 9B, the top surface 44 of the tubular body 21 has a T-shaped profile, transverse to the longitudinal length L of the railed handguard 20. The T-shaped profile of the top surface 44 of the tubular body 21 may contain the charging rod slot 21*b* extending longitudinally from the first end 42*a* to the second end 42*b* of the tubular body 21. The charging rod slot 21*b* houses the charging rod 23, explained in more detail herein below.

The bottom surface 46 of the tubular body 21, as shown in FIG. 2C, the bottom surface 46 may include a plurality of apertures 54 (bottom plurality of apertures). The plurality of apertures 54 may be spatially disposed along the length of the bottom surface 46 of the tubular body 21 between the first end 42*a* and the second end 42*b*. While the plurality of apertures 54 in FIG. 2C are shown as having an elongated rectangular shape, it is understood that the plurality of apertures 54 may have any geometric shape as described herein above.

Referring now to the side surfaces 48, 50 of the tubular body 21, namely a first side surface (left-side surface) 48 and second side surface (right side surface) 50 comprise a first side portion 48*a*. 50*a*, a second side portion 48*b*, 50*b*, and a third side portion 48*c*, 50*c* (FIG. 2D; left side surface 48 shown). Each of the first, second, and third side portions 48*a-c*, 50*a-c* are positioned between the top surface 44 and bottom surface 46 and extend longitudinally from the first end 42*a* to the second end 42*b* of the tubular body 21. The first side portion 48*a*, 50*a* and the third side portion 48*c*, 50*c* are angled with respect to the second side portion 48*b*, 50*b*. As such, the top surface 44, bottom surface 46, and side surfaces 48, 50 comprising first, second, and third side portions 48*a-c*, 50*a-c* meet together at angled abutments to form a substantially octagonal shape.

At least one of the first, second, and third side portions 48*a-c*, 50*a-c* of the side surfaces 48, 50 may include a plurality of apertures 56 (side plurality of apertures). The plurality of apertures 56 may be spatially disposed along the longitudinal length L of the tubular body 21 between the first end 42*a* and the second end 42*b* of the first, second, and third side portions 48*a-c*, 50*a-c*. The plurality of apertures 56 may be positioned at the opposing ends 42*a*, 42*b* of the first, second, and third side portions 48*a-c*, 50*a-c*. The plurality of apertures 56 may be positioned at or near the midpoint region of one or more of the first, second, and third side portions 48*a-c*, 50*a-c*. One or more apertures of the plurality of apertures 56 may extend from one side portion 48*a-c*, 50*a-c* to another side portion 48*a-c*, 50*a-c*, spanning over adjacent portions 48*a-c*, 50*a-c* of the side surfaces 48, 50. For example, an aperture 56 may extend from the first side portion 48*a*, 50*a* to the second side portion 48*b*, 50*b* and/or from the second side portion 48*b*, 50*b* to the third side portion 48*c*, 50*c*.

Furthermore, the left side surface 48 of the tubular body 21, the right side surface 50 of the tubular body 21, or both may comprise elongating receiving slots 58*a*, 58*b*. This allows the user of the firearm to position the charging handles 24, 25; 124, 125 on either or both sides of the handguard 20 depending on if the user is left or right-handed. Each of the elongating receiving slots 58*a*, 58*b* may function to slidably receive a projection of the charging handles 24, 25; 124, 125 that extend therethrough. More specifically, the left-sided charging handle 24, 124 extends through the left-side elongated receiving slot 58*a* from an interior of the tubular body 21 of the railed handguard 20 to an exterior of the tubular body 21 of the railed handguard 20. The right-sided charging handle 25, 125 extends through the right-sided elongated receiving slot 58*b* from an interior of the tubular body 21 of the railed handguard 20 to an exterior of the tubular body 21 of the railed handguard 20. The elongated receiving slots 58*a*, 58*b* may be defined by the first side portion 48*a*, 50*a* of the tubular body 21. The elongating receiving slots 58*a*, 58*b* may extend substantially parallel to the longitudinal length L of the handguard 20. The elongating receiving slots 58*a*, 58*b* extend between the first end 42*a* and the second end 42*b* of the handguard 20, but do not extend along the entire longitudinal length L of the tubular body 21 of the railed handguard 20.

The elongated receiving slots 58*a*, 58*b* may further define a top engagement portion 60, a bottom engagement portion 61, and a takedown portion 59. The takedown portion 59 of the elongated receiving slots 58*a*, 58*b* may function to allow the charging handles 24, 25; 124, 125 to be loaded and unloaded from the handguard 20 when the bolt carrier group is in a withdrawn position, explained in more detailed herein below. While the elongated receiving slots 58*a*, 58*b* in FIGS. 2A, 2B, and 2D are shown as an elongated L-shaped slot, it is understood that the elongated receiving slots 58*a*, 58*b* may have any geometric shape suitable to provide a proper fit for the charging handles 24, 25; 124, 125 of the charging handle assembly 22, 122 of the present disclosure.

Figure 3B:
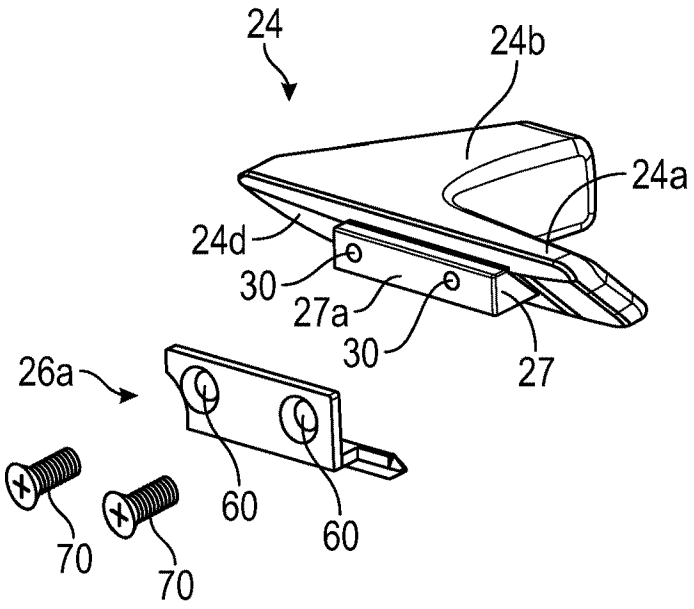
FIG. 3B is a partially exploded perspective view of selected components of the first exemplary embodiment of a charging handle assembly including a left-sided charging handle, a left-sided charging handle plate, and securing features depicted as screws.
Figure 3A:
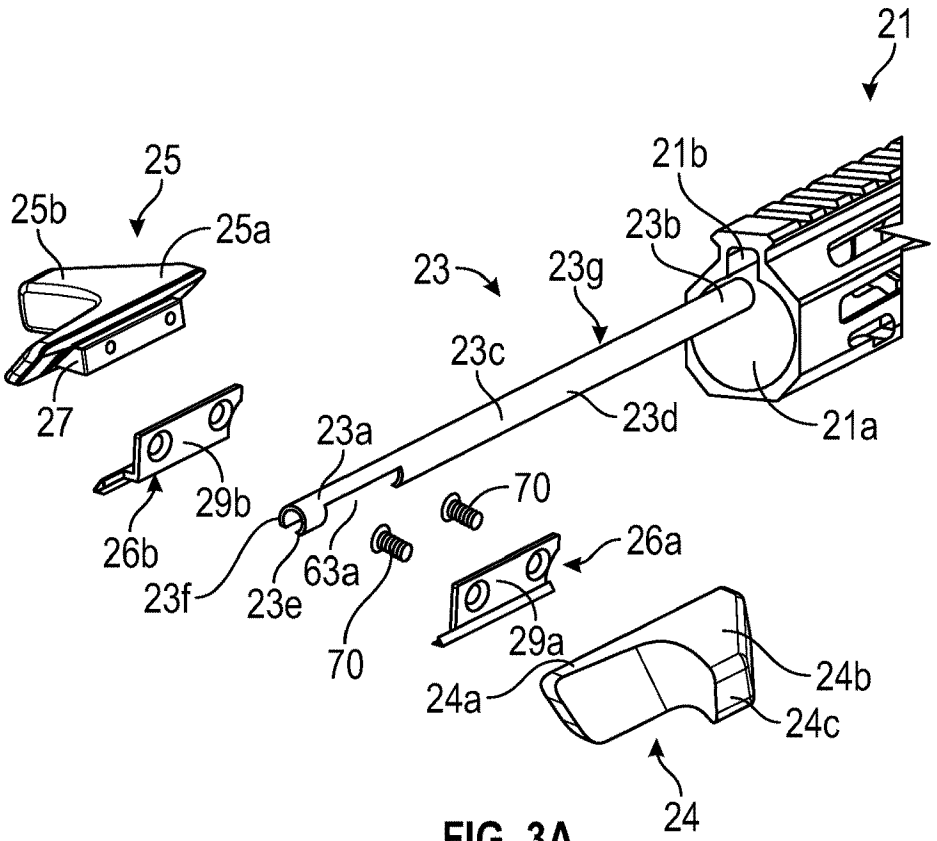
FIG. 3A is a partially exploded perspective view of the components of a first exemplary embodiment of the charging handle assembly including a pair of charging handles, a pair of charging handle plates, securing features, and a charging rod, shown with the illustrative railed handguard.

As shown in FIGS. 1 and 3A, the charging system 71 may comprise a bolt carrier group 72 having a front end 72*a* and a rear end 72*b*, a spring 73, a buffer 74, a charging rod 23, and a charging handle assembly 22, 122. The buffer 74 is disposed between the bolt carrier group 72 and the spring 73 and the bolt carrier group rear end 72*b*, such that the bolt carrier group rear end 72*b* is operatively engaged with the buffer 74. The charging rod 23 is disposed in the handguard bore 21 and engaged with the front end of the bolt carrier group 72.

The charging handle assembly 22, 122 is thereby coupled to the charging rod 23 and engaged with the elongated receiving slot 58*a*, 58*b*. The charging handle assembly 22, 122 generally comprises at least one charging handle 24, 25; 124, 125 and at least one charging handle plate 26*a*, 26*b*; 126*a*, 126*b* disposed between and operatively coupled to the at least one charging handle 24, 25; 124, 125 and the charging rod 23.

Figure 6A:
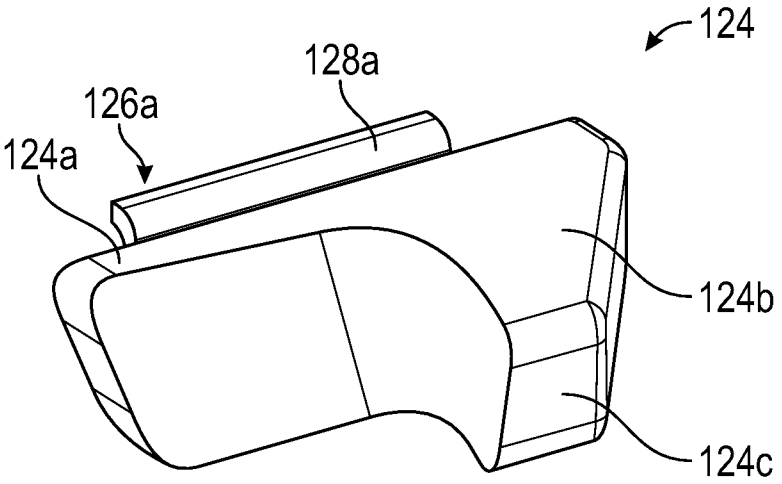
FIG. 6A is a perspective view of a second exemplary embodiment of a charging handle assembly, particularly a left-sided charging handle with charging handle plate integrally formed thereon.
Figure 6B:
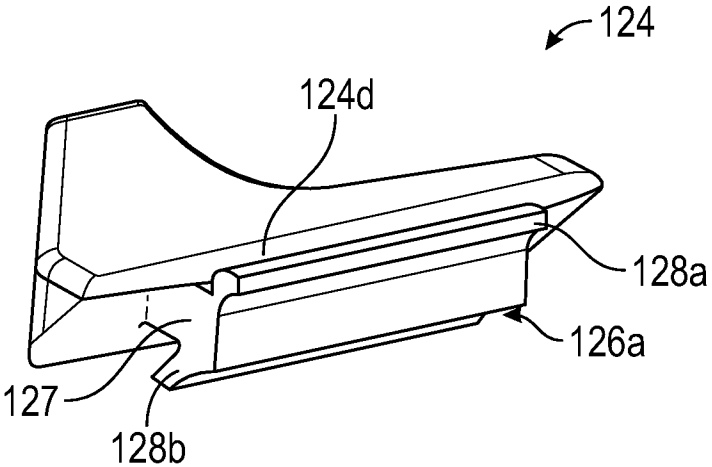
FIG. 6B is a rear perspective view of the illustrative left-sided charging handle of FIG. 6A.
Figure 10:
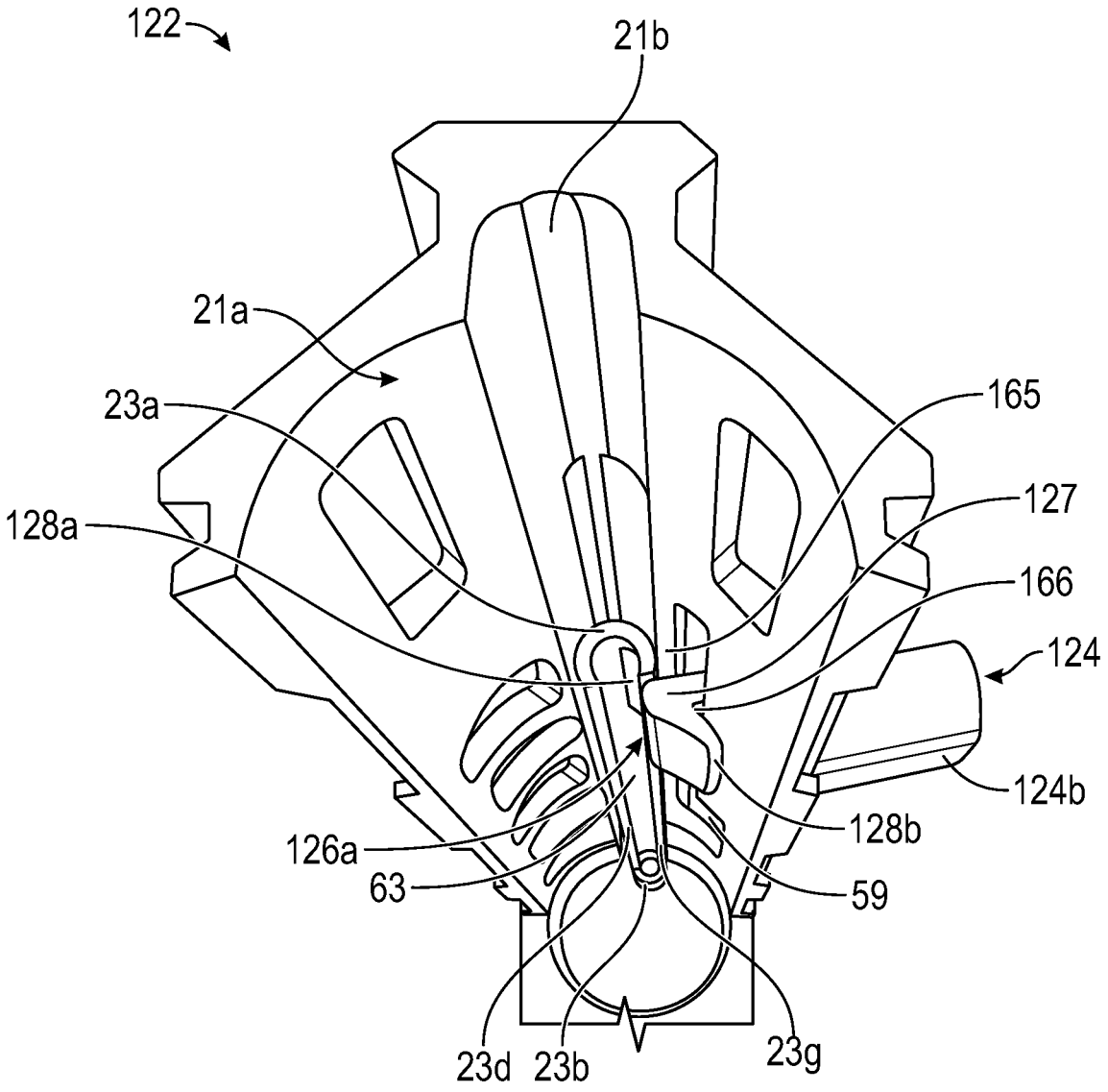
FIG. 10 is an interior perspective view of the second exemplary embodiment of the charging handle assembly as assembled within the railed handguard of the present disclosure.

Referring specifically to the components of the charging handle assembly 22, 122 in more detail, a first embodiment of the charging handle assembly 22 with charging handles 24, 25 is shown in FIGS. 3A-3B, 4A-4E, and 5, and a second embodiment of the charging handle assembly 122 with charging handles 124, 125 is shown in FIGS. 6A-6B and 10. Common features between the first and second exemplary embodiments are identified with common terms and reference numerals throughout. Features of the first and second embodiment that are structurally different but perform at least some common functions are referenced with common terms; the reference numerals of the second exemplary embodiment are increased by 100. It should be appreciated that these two embodiments are exemplary and, as such, the charging handles and associated components may be one of several other embodiments not particularly described herein without departing from the nature of the present disclosure.

As shown generally in FIGS. 3A-3B, 4A-4E, 5, and 6A-6B, both charging handle assemblies 22, 122 comprise a pair of charging handles, left-sided charging handle 24, 124 and right-sided charging handle 25, 125. Each of the left-sided charging handles 24, 124 and right-sided charging handles 25, 125 include a base portion 24*a*, 25*a*; 124*a*, 125*a* and a lever portion 24*b*, 25*b*; 124*b*, 125*b* operatively connected to the base portion 24*a*, 25*a*; 124*a*, 125*a*. The lever portion 24*b*, 25*b*; 124*b*, 125*b* extends in an outward direction from the base portion 24*a*, 25*a*; 124*a*, 125*a* in a substantially L-shaped configuration, and has an exterior side face 24*c*, 25*c*; 124*c*, 125*c*. The base portion further defines an interior side face 24*d*, 25*d*; 124*d*, 125*d* with a plate attachment region 27, 127 protruding at an angled abutment therefrom and integrally formed thereon.

The plate attachment region 27, 127 may aid in the attachment of the charging handles 24, 25 to the charging plates 26*a*, 26*b* and/or aid in the slidable engagement of the charging handles 24, 25; 124, 125 to the elongated receiving slot 42 machined within the handguard body 21, described in more detail herein below. In one example, the base portion 24*a*, 25*a*; 125*a*, 125*a* and lever portion 24*b*, 25*b*; 124*b*, 125*b* are integrally connected, e.g., formed of a single unitary piece.

As such, the charging handles 24, 25; 124, 125 may be non-pivoting, e.g., the charging handles 24, 25; 124, 125 do not independently rotate or pivot during operation. As such, the non-pivoting design simplifies the number of component parts, which reduces overall weight of the firearm and minimizes the risk of malfunction during operation. Furthermore, it is envisioned that the charging handles 24, 25; 124, 125 of the present disclosure are ambidextrous. A user may operate the firearm 10, 100 in a left or right handed capacity, by pulling rearwardly on the left-sided charging handle lever 24*b*, 124*b* or by pulling rearwardly on the right-sided charging handle lever 25*b*, 125*b*, respectively or may engage both handles simultaneously.

Figure 4A:
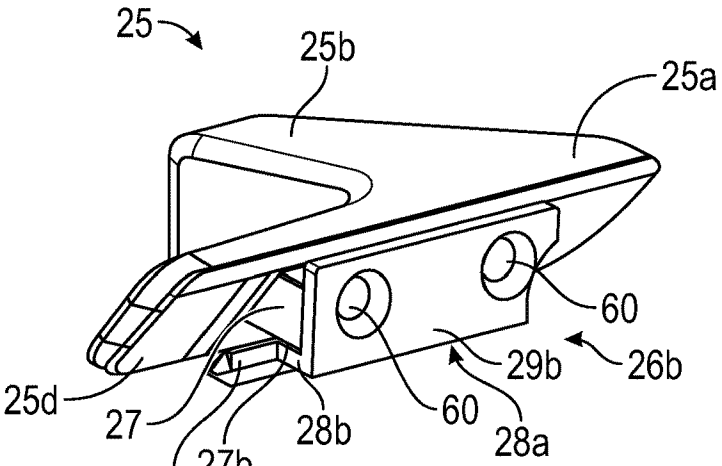
FIG. 4A is a perspective view of an illustrative right-sided charging handle plate secured to an illustrative right-sided charging handle via securing features, depicted as screws, of the first exemplary embodiment.
Figure 4B:
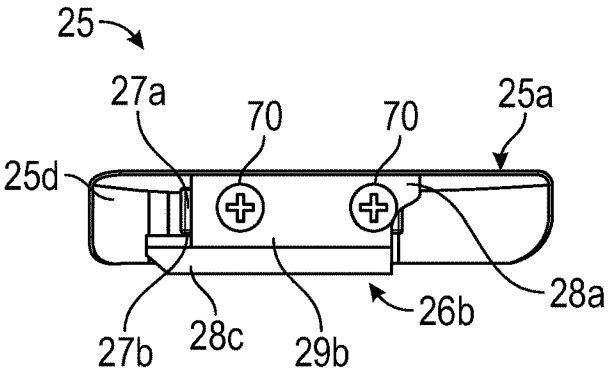
FIG. 4B is a side view of the illustrative right-sided charging handle plate secured to the illustrative right-sided charging handle via securing features, depicted as screws, of the first exemplary embodiment.
Figure 4D:
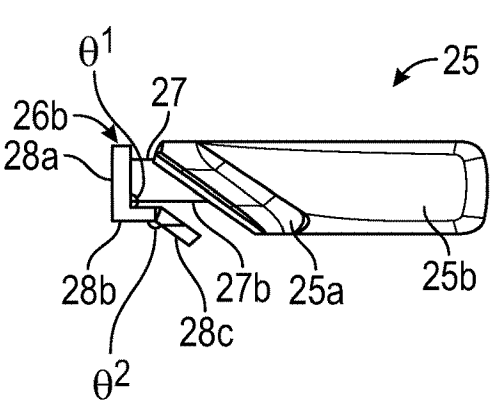
FIG. 4D is a rear view of the illustrative right-sided charging handle plate secured to the illustrative right-sided charging handle of the first exemplary embodiment.
Figure 4E:
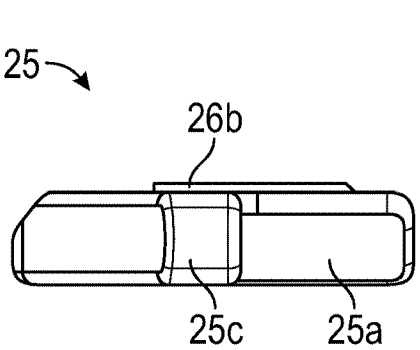
FIG. 4E is another side view of the illustrative right-sided charging handle plate secured to the illustrative right-sided charging handle of the first exemplary embodiment.
Figure 4C:
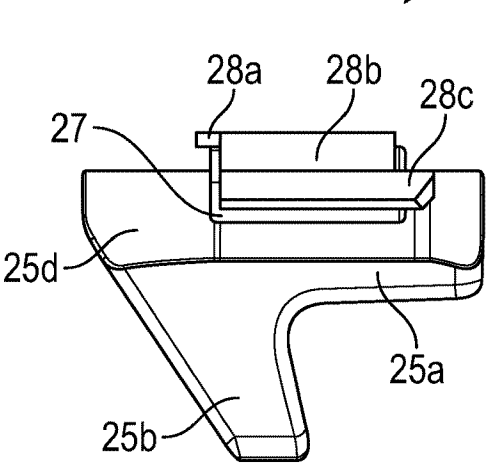
FIG. 4C is a bottom view of the illustrative right-sided charging handle plate secured to the illustrative right-sided charging handle of the first exemplary embodiment.
Figure 5:
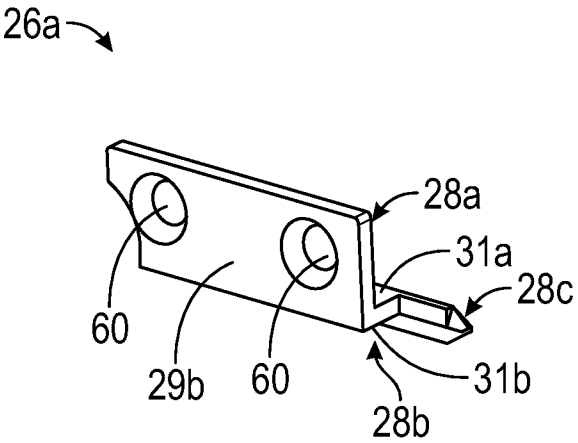
FIG. 5 is a perspective view of an illustrative left-sided charging handle plate of the first exemplary embodiment.

Turning more specifically to the first exemplary embodiment of the charging handle assembly 22 with charging handles 24, 25, the charging handle assembly 22 may further comprise charging handle plates 26*a*, 26*b* (corresponding to a left-sided plate and a right-sided plate, respectfully) as shown in FIGS. 3A-3B, 4A-4E, and 5. The charging handle plates 26*a*, 26*b* may be secured to the plate attachment region 27 of the charging handles 24, 25, as described in the assembly steps herein below. As shown in FIG. 5, each of the left-sided and right-sided plates 26*a*, 26*b* may be substantially Z-shaped and, as such, correspond in shape to the plate attachment region 27 of the left-sided and right-sided charging handles 24, 25. More specifically, as illustrated in FIGS. 3A and 3B, the plate attachment region 27 is located on the interior side face 24*d*, 25*d* of the base portion 24*a*, 25*a* of charging handles 24, 25 and has a front receiving face 27*a* and a bottom receiving face 27*b*. The front receiving face 27*a* and bottom receiving face 27*b* meet at an angled abutment, with complementary geometry to the plate 26*a*, 26*b*. The front receiving face 27*a* further includes a plurality of securement apertures 30. The plurality of securement apertures 30 are utilized for securement of the plates 26*a*, 26*b* to the plate attachment regions 27 of the charging handles 24, 25. The plurality of securement apertures 30 may be spatially arranged upon the front receiving face 27*a* of the plate attachment regions 27. Alternatively, the plurality of securement apertures 30 may be located at opposing ends of the front receiving face 27*a* of the plate attachment regions 27.

The charging handle plates 26*a*, 26*b* may further comprise a first portion 28*a*, a second portion 28*b*, and a third portion 28*c*. As shown in FIGS. 4A-4E generally, and more specifically in FIG. 4D, the first portion 28*a* of the charging handle plate 26*a*, 26*b* and the second portion 28*b* of the charging handle plate 26*a*, 26*b* may meet at an angled abutment. In one example, the inner angle $\theta^1$ of the first portion 28*a* to the second portion 28*b* may be substantially perpendicular. Furthermore, the second portion 28*b* of the plate 26*a*, 26*b* extends from the first portion 28*a* of the plate 26*a*, 26*b* to a third portion 28*c* of the plate 26*a*, 26*b*. In one example, the second portion 28*b* creates an obtuse angle $\theta^2$ with respect to the third portion 28*c*, which is opposite the angle $\theta^1$ of the first portion 28*a* and second portion 28*b*.

In addition, the first portion 28*a* of the plates 26*a*, 26*b* may further define a first portion interior surface 29*a* and a first portion exterior surface 29*b*. The second portion 28*b* of the plates 26*a*, 26*b* may further define a second portion interior surface 31*a* and a second portion exterior surface 31*b*. A plurality of securement apertures 62 may extend through an entirety of a thickness of the plate 26*a*, 26*b*. The plurality of securement apertures 62 may be operative for the securement of the plate 26*a*, 26*b* to the plate attachment region 27 of the charging handle 24, 25. The plurality of securement apertures 62 may be spatially arranged along the length of the first portion 28*a* of the plate 26*a*, 26*b*. Alternatively, the plurality of securement apertures 62 may be located at opposing ends of the first portion 28*a* of the plate 26*a*, 26*b*. It is contemplated that the location of the securement apertures 62 of the plate 26*a*, 26*b* correspond in location to the securement apertures 30 on the front receiving face 27*a* of the plate attachment region 27 of the charging handles 24, 25 such that the securement apertures 30, 62 align during assembly, enabling the same to be securely fastening together via a plurality of attachment features 70 (FIGS. 3A and 3B) received therethrough.

FIGS. 4A-4E show the assembly of the plates 26*a*, 26*b* to the plate attachment regions 27 of the charging handles 24, 25. During assembly, the first portion interior surface 29*a* of the first portion 28*a* of the plate 26*a*, 26*b* engages the front receiving face 27*a* of the plate attachment region 27 such that the plurality of securement apertures 62 on the first portion 28*a* of the plate 26*a*, 26*b* align with the plurality of securement apertures 30 on the front receiving face 27*a* of the plate attachment region 27. Furthermore, the second portion interior face 31*a* of the second portion 28*b* of the of the plate 26*a*, 26*b* engages the bottom receiving face 27*b* of the plate attachment region 27 of the charging handle 24, 25. As such, the third portion 28*c* may be substantially parallel with the base portion 24*a*, 25*a* of the charging handle 24, 25. Once engaged, a top track 65 is defined between the interior side face 24*d*, 25*d* of the base portion 24*a*, 25*a* of the handle 24, 25 and the first portion 28*a* of the plate 26*a*, 26*b*, and a bottom track 66 is defined between the interior side face 24*d*, 25*d* of the base portion 24*a*, 25*a* of the handle 24, 25 and the second portion 28*b* of the plate 26*a*, 26*b*.

The top track 65 of the charging handle assembly abuts and slidably engages the top engagement portion 60 of the elongated receiving slot 58*a*, 58*b* and the bottom track 66 of the charging handle assembly abuts and slidably engages a bottom engagement portion 61 of the elongated receiving slot 58*a*, 58*b*, such that the charging plate 26*a*, 26*b* is disposed in and engages the charging rod cavity 63*a*. 63*b* to operatively couple the charging handle assembly and the charging rod 23.

As illustrated in FIGS. 3A, 3B, and 4B, securement of the plate 26*a*, 26*b* to the plate attachment region 27 of the charging handle 24, 25 may further comprise insertion of the plurality of attachment features 70 through the plurality of apertures 30, 62. Furthermore, it is contemplated that the corresponding apertures 30, 62 may be threaded or otherwise adapted to receive the corresponding attachment features 70 in a secure manner. While attachment features 70 are depicted in FIGS. 3A, 3B and 4B as screws, it will be appreciated that other suitable means may be utilized as necessary to achieve the desired result within view of the present teachings. Lastly, it is contemplated that suitable attachment features 70 may be formed of any suitable material including, but not limited to, a metallic material.

As a result of the steps described herein above and as illustrated in FIGS. 4A-4E, each of the left-sided and right-sided plates 26*a*, 26*b* are secured to the plate attachment regions 27 of the respective left-sided and right-sided charging handles 24, 25 in a two-piece construction.

Next, as illustrated in more detail in FIGS. 6A and 6B, a second example embodiment of the charging handle assembly 122 with charging handles 124, 125 is shown. In this second example embodiment, the charging handle plates 126*a*, 126*b* (corresponding to a left-sided plate and a right-sided plate, respectfully) are integrally formed with the plate attachment region 127 of the charging handles 124, 125. Said another way, the plate 126*a*, 126*b* and plate attachment region 127 are formed as a single, unitary structure. As such, it is envisioned that the charging handle 124, 125, charging handle attachment region 127, and charging handle plate 126*a*, 126*b* are formed of the same material. This single, one-piece construction simplifies the number of component parts necessary, which aids in overall cost and weight reduction of the resultant firearm 10, 100.

More specifically, the charging handle plates 126*a*, 126*b* in this second embodiment may be substantially j-shaped, each comprising a first portion 128*a* and a second portion 128*b*, each extending along the horizontal length of the plate attachment region 127. The first portion 128*a* defines a top track 165 between the interior side face 124*d*, 125*d* of the handle 124, 125 and the first portion 128*a*. The second portion 128*b* defines a bottom track 166 between the interior side face 124*d*, 125*d* of the handle 124, 125 and the second portion 128*b*.

The charging rod 23. FIGS. 1, 3A, and 10 illustrate an exemplary charging rod 23 of the present disclosure. The charging rod 23 may be located in a position above the barrel 16 and housed within the charging rod slot 21*b* of the tubular body 21 of the railed handguard 20.

The charging rod 23 may comprise a body 23*g* having a first end 23*a* and a second end 23*b*. The body 23*g* may further define an elongated through-slot 63 that extends from the first end 23*a* to the second end 23*b*. The charging rod body 23*g* further defines a top portion 23*c*, a bottom portion 23*d*, a left-side portion 23*e*, and a right-side portion 23*f*. The bottom portion 23*d* further defines the elongated through-slot 63 cut within the bottom portion 23*d*, which may extend all the way through the first end 23*a* of the charging rod 23, such that the first end 23*a* of the charging rod 23 is open in configuration. The elongated through-slot 63 may terminate short of the second end 23*b* of the charging rod 23 such that the second end 23*b* of the charging rod 23 is closed in configuration.

The charging rod 23 is operatively coupled to the charging handles 24, 25; 124, 125 via the charging handle plate 26*a*, 26*b*; 126*a*, 126*b*. As such, the body 23*g* may define a charging rod cavity 63*a*. 63*b* closer to the first end 23*a* of the charging rod than to the second end 23*b* of the changing rod. The charging rod cavity 63*a*. 63*b* extends in an upward direction from the bottom portion 23*d* of the charging rod 23 towards the top portion 23*c* of the charging rod 23 and are configured in shape to receive the corresponding left or right-sided plate 26*a*, 26*b*; 126*a*, 126*b* of the charging handle assembly 22, 122 during assembly thereof. Said another way, the charging rod cavity 63*a*. 63*b* is configured to receive the charging handle plate 26*a*, 26*b*; 126*a*, 126*b*.

Lastly. FIGS. 7, 8. 9A and 9B generally show the charging handle assembly 22 of the present disclosure including charging handles 24, 25; 124, 125, and charging handle plates 26*a*, 26*b*; 126*a*; 126*b*, with charging rod 23, in its assembled state and housed within the corresponding railed handguard 20 of the present disclosure. More specifically. FIGS. 7 and 8 show the assembled charging handle assembly 22, 122 as attached to an exemplary upper receiver body 14 and housed within the corresponding railed handguard 20. FIGS. 9A and 9B. FIG. 9A show the repositioned charging handle assembly 22, 122 in accordance with the present disclosure on an exemplary assembled firearm 100 and housed within the corresponding railed handguard 20. FIG. 9B shows a cross-sectional view of the exemplary assembled firearm 100 taken along line B-B in FIG. 9A.

Figure 11:
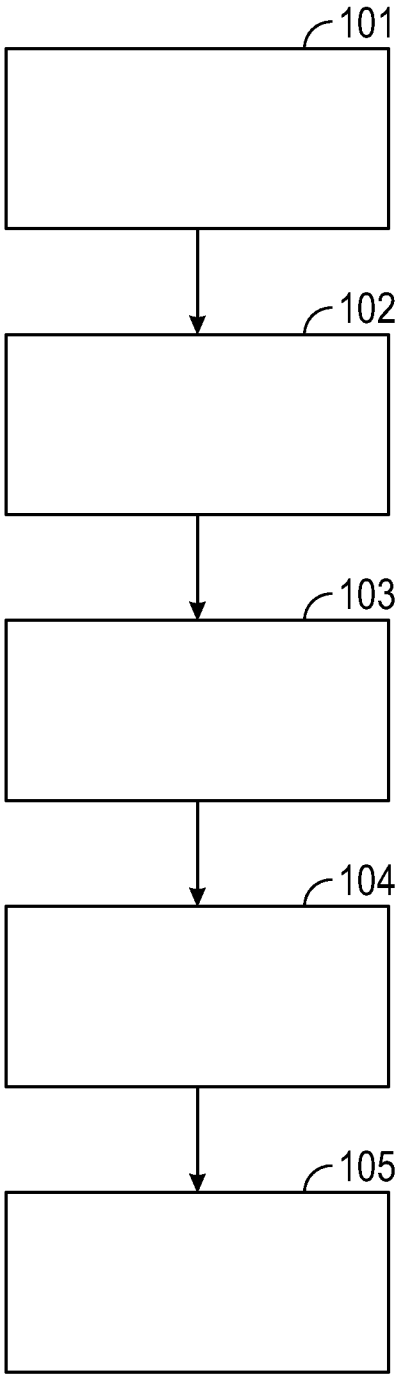
FIG. 11 is a flow chart detailing the steps of the present method of assembling a firearm.

More particularly, as shown in FIGS. 9B and 10, components of the charging handle assembly 22, 122 and charging rod 23 of the present disclosure are housed within the tubular handguard body 21 of the railed handguard 20. As detailed in FIG. 11, at step 101, during assembly of the firearm 10, 100 in accordance with the present method, the charging rod 23 is first inserted into the charging rod slot 21*b* of the handguard bore 21*a* (first end 23*a* of charging rod 23 inserted first). More particularly, the charging rod 23 is inserted into a charging rod slot 21*b* defined by the elongated handguard bore 21*a*, such that the first end 23*a* of the charging rod body 23*g* is slidably received by the charging rod slot 21*b* defined by the handguard 20 at the first end of the handguard 42*a*.

Next, at step 102, the charging handle assembly 22, 122 is inserted into the takedown portion 59 of the elongated receiving slot 58*a*, 58*b* such that the top track 65 of the charging handle assembly slidably engages the top engagement portion 60 of the elongated receiving slot 58*a*, 58*b* and the bottom track 66 of the charging handle assembly slidably engages a bottom engagement portion 61 of the elongated receiving slot 58*a*, 58*b*. More particularly, the charging handles 24, 25; 124, 125, with charging handle plates 26*a*, 26*b*; 126*a*, 126*b* attached or integrally formed thereon as described herein above, are inserted into the takedown portion 59 of the elongated receiving slots 58*a*, 58*b* on the tubular handguard body 21 of the handguard 20 from an exterior of the handguard body 21 to an interior of the handguard body 21, engaging the charging rod 23 and handguard body 21. More specifically, the left-sided charging handle 24, 124 extends through the takedown portion 59 of the elongated receiving slot 58*a* and the right-sided charging handle 25, 125 extends through the takedown portion 59 of the elongated receiving slot 58*b*.

Furthermore, when the charging handles 24, 25; 124, 125, with charging handle plates 26*a*, 26*b*; 126*a*, 126*b*, are inserted into the takedown portion 59 of the elongated receiving slot 58*a*, 58*b*, the charging handles 24, 25; 124, 125 are slidably supported by the handguard body 21. More specifically, as shown in FIG. 10 (with components of the second exemplary embodiment), the top track 65, 165 of the charging handle 24, 25; 124, 125 and plate 26*a*, 26*b*; 126*a*, 126*b* assembly abuts and slidably engages the top portion of the elongated receiving slot 58*a*, 58*b* and the bottom track 66, 166 of the charging handle 24, 25; 124, 125 and plate assembly 26*a*, 26*b*; 126*a*, 126*b* abuts and slidably engages the bottom portion of the elongated receiving slot 58*a*, 58*b*.

As such, at step 103, the charging handle plate 26*a*, 26*b*; 126*a*, 126*b* of the charging handle assembly 22, 122 is aligned with the charging rod cavity 63*a*. 63*b* of the charging rod 23, such that the first portion of the charging handle plate engages the charging rod cavity 63*a*. 63*b*. More specifically, when the charging handle plates 26*a*, 26*b*; 126*a*, 126*b* are aligned with and engage the charging rod 23, the left-sided through-slot cavity 63*a* of the charging rod 23 is configured to receive a top portion of the first portion 28*a*, 128*a* of the left plate 26*a*, 126*a* and the right-sided through-slot cavity 63*b* of the charging rod 23 is adapted to receive a top portion of the first portion 28*a*, 128*a* of the right plate 26*b*, 126*b*. Said another way, the charging handles 24, 25; 124, 125 and plates 26*a*, 26*b*; 126*a*, 126*b* fit within the respective through-slot cavities 63*a*. 63*b* of the charging rod 23.

Then, at step 104, the charging handle assembly 22, 122, slidably supported by the handguard body 21 and engaged with the charging rod 23, is slid along the length of the elongated receiving slot 58*a*, 58*b* toward the second end 42*b* of the handguard 20, in a direction away from the takedown portion 59 of the elongated receiving slot 58*a*, 58*b* to allow for insertion of the bolt carrier group 72.

Lastly, at step 105, the bolt carrier group 72 is inserted into the rear of the upper receiver 14 such that the second end 23*b* charging rod 23 engages the front end 72*a* of the bolt carrier group 72. When the charging handle assembly 22, 122 and charging rod 23 are transitioned between a first position A (i.e., an uncharged position) and a second position B (i.e., a charged position), the charging rod 23 pushes the front end of the bolt carrier group 72 in the first direction 99 thereby compressing a spring 73, such that the spring 73 launches the bolt carrier group 72 into a charged position thereby charging the firearm 10, 100.

In the manner described above, the charging handle assembly and corresponding handguard for receipt of the repositioned charging handle of the present teachings allows for allows for the ambidextrous, forward, non-reciprocating charging of the firearm.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Benefits, other advantages, and solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

LISTING OF REFERENCE NUMERALS

10, 100 Firearm
12 Upper Receiver Portion (of Firearm 10, 100)
14 Upper Receiver Body
15 Scope
16 Barrel
17 Mud Plug
18 Barrel Nut
20 Railed Handguard
21 Tubular Handguard Body
21*a* Handguard Bore
21*b* Charging Rod Slot (of Handguard Bore 21*a*)
22, 122 Charging Handle Assembly
23 Charging Rod
23*a* First End (of Charging Rod 23)
23*b* Second End (of Charging Rod 23)
23*c* Top Portion (of Charging Rod 23)
23*d* Bottom Portion (of Charging Rod 23)
23*e* Left-Side Portion (of Charging Rod 23)
23*f* Right-Side Portion (of Charging Rod 23)
23*g* Body (of Charging Rod 23)
24, 124 Charging Handle (Left Side)
24*a*, 124*a* Base Portion
24*b*, 124*b* Lever Portion
24*c*, 124*c* Exterior Side Face (of Lever Portion 24*b*)
24*d*, 124*d* Interior Side Face (of Base Portion 24*a*)
25, 125 Charging Handle (Right Side)
25*a*, 125*a* Base Portion
25*b*, 125*b* Lever Portion
25*c* Exterior Side Face (of Lever Portion 25*b*)
25*d* Interior Side Face (of Base Portion 25*a*)
26*a*, 126*a* Charging Handle Plate (Left Side)
26*b*, 126*b* Charging Handle Plate (Right Side)
27, 127 Charging Handle Plate Attachment Region
27*a* Front Receiving Face (of Plate Attachment Region 27, 127)
27*b* Bottom Receiving Face (of Plate Attachment Region 27, 127)
28*a*, 128*a* First Portion
28*b*, 128*b* Second Portion
28*c* Third Portion
29*a* First Portion Interior Surface (of First Portion 28*a*, 128*a*)
29*b* First Portion Exterior Surface (of First Portion 28*a*, 128*a*)
30 Plurality of Securement Apertures
31*a* Second Portion Interior Surface (of Second Portion 28*b*, 128*b*)
31*b* Second Portion Exterior Surface (of Second Portion 28*b*, 128*b*) 31*b*
32 Lower Receiver Portion (of Firearm 10, 100)
33 Lower Receiver
34 Pistol Grip
36 Trigger Mechanism
38 Magazine Slot
40 Buttstock
41 Receiver Extension
42*a* First End (of Handguard 20)

42*b* Second End (of Handguard 20)
44 Top Surface (of Handguard 20)
46 Bottom Surface (of Handguard 20)
48 Left Side Surface (of Handguard 20)
48*a* First Side Portion (of Left Side Surface 48)
48*b* Second Side Portion (of Left Side Surface 48)
48*c* Third Side Portion (of Left Side Surface 48)
50 Right Side Surface (of Handguard 20)
50*a* First Side Portion (of Right Side Surface 50)
50*b* Second Side Portion (of Right Side Surface 50)
50*c* Third Side Portion (of Right Side Surface 50)
52 Rail System
52*a* Ribs (of Rail System 52)
52*b* Valleys (of Rail System 52)
54 Plurality of Apertures
56 Plurality of Apertures
58*a* Elongated Receiving Slot (of Handguard 20)
58*b* Elongated Receiving Slot (of Handguard 20)
59 Takedown Portion (of Elongated Receiving Slot 58*a*, 58*b*)
60 Top Engagement Portion (of Elongated Receiving Slot 58*a*, 58*b*)
61 Bottom Engagement Portion (of Elongated Receiving Slot 58*a*, 58*b*)
62 Plurality of Securement Apertures
63 Elongated Through-Slot of Charging Rod
63*a* Charging Rod Cavity (Left-Side)
63*b* Charging Rod Cavity (Right-Side)
65, 165 Top Track
66, 166 Bottom Track
70 Attachment Features
71 Charging System
72 Bolt Carrier Group
72*a* Bolt Carrier Group Front End
72*b* Bolt Carrier Group Rear End
73 Spring
74 Buffer
99 First Direction
A First Position (Uncharged Position)
B Second Position (Charged Position)
L Longitudinal Length of Handguard

What is claimed is:

1. A firearm comprising:

a handguard having a first end, a second end, and an elongated handguard bore that extends from the first end to the second end defining a longitudinal length of the handguard, wherein the hand guard further defines an elongated receiving slot having a top engagement portion and a bottom engagement portion;

a charging system comprising:

a bolt carrier group having a front end and a rear end;

a spring and a buffer, wherein the buffer is disposed between the bolt carrier group and the spring and wherein the bolt carrier group rear end is operatively engaged with the buffer;

a charging rod disposed in the handguard bore and engaged with the front end of the bolt carrier group;

a charging handle assembly coupled to the charging rod and engaged with the elongated receiving slot, the changing handle assembly comprising:

at least one charging handle; and at least one charging handle plate wherein the at least one charging handle plate is disposed between and operatively couples the at least one charging handle and the charging rod, the at least one charging handle plate comprising: a first portion defining a first portion interior surface and a first portion exterior surface; a second portion defining a second portion interior surface and a second portion exterior surface, and a third portion, wherein:

the first portion and second portion are coupled at a first angled abutment;

the second portion extends from the first portion to the third portion, such that the second portion and the third portion are coupled at a second angled abutment; and the second angled abutment comprises an obtuse angle between the second portion and the third portion; and wherein the charging handle assembly and the charging rod are movable between a first position and a second position, such that when the charging handle assembly is moved in a first direction within the elongated receiving slot the charging rod pushes the front end of the bolt carrier group in the first direction thereby compressing the spring, such that the spring launches the bolt carrier group into a charged position thereby charging the firearm.

2. The firearm of claim 1, wherein the handguard further comprises:

a plurality of surfaces that extend from the first end of the handguard to the second end of the handguard along the longitudinal length thereof, wherein the plurality of surfaces includes a top surface, a bottom surface, a first side surface and a second side surface opposite the first side surface, wherein the first side surface and the second side surface are disposed between the top surface and the bottom surface; and wherein the elongated receiving slot is defined by at least one of the first side surface and the second side surface, the elongated receiving slot furthering defining a take-down portion configured to accommodate the charging handle assembly.

3. The firearm of claim 2, wherein the handguard comprises a plurality of apertures disposed on at least one of the top surface, the bottom surface, the first side surface, and the second side surface, and wherein the top surface further defines a rail system having a plurality of ribs and valleys, wherein the rail system is configured to receive at least one rail-mountable accessory.

4. The firearm of claim 1, wherein:

the handguard further defines a charging rod slot is disposed proximate to the top surface of the handguard and extends from the first end of the handguard to the second end of the handguard and is further configured to slidably receive the charging rod between the handguard first end and the handguard second end; and the charging rod slot and the handguard bore collectively defines an inner surface of the handguard.

5. The firearm of claim 4, wherein the charging rod further comprises:

a body having a first end and a second end, and further defining an elongated through-slot that extends from the first end to the second end;

wherein the body further defines a charging rod cavity closer to the first end of the charging rod than to the second end of the changing rod, such that the charging rod cavity is configured to receive the charging handle plate.

6. The firearm of claim 5, wherein the at least one charging handle further comprises:

a base portion; and a lever portion operatively connected to the base portion, wherein the lever portion extends in an outward direction from the base portion; and wherein the base portion further defines a plate attachment region.

7. The firearm of claim 6 wherein the base portion and the lever portion are formed as a single unitary piece.

8. The firearm of claim 7 wherein:

the plate attachment region further comprises a front receiving face, wherein the front receiving face defines a first plurality of securement apertures disposed upon the front receiving face;

the first portion of the at least one charging handle plate includes a second plurality of securement apertures disposed along a length of first portion of the charging handle plate; and each of the first plurality of securement apertures and the second plurality of securement apertures are configured to receive one of a plurality of attachment features, such that the plurality of attachment features secures the charging handle plate to the plate attachment region of the charging handle.

9. The firearm of claim 8, wherein:

the base portion of the charging handle defines an interior side face;

the charging handle assembly further defines a top track disposed between the interior side face of the base portion of the charging handle and the first portion of the charging plate; and the charging handle assembly further defines a bottom track disposed between the interior side face of the base portion of the charging handle and the second portion of the charging plate.

10. The firearm of claim 9, wherein the top track of the charging handle assembly abuts and slidably engages the top engagement portion of the elongated receiving slot and the bottom track of the charging handle assembly abuts and slidably engages a bottom engagement portion of the elongated receiving slot, such that the charging plate is disposed in and engages the charging rod cavity to operatively couple the charging handle assembly and the charging rod.

11. The firearm of claim 7, wherein the at least one charging handle is fixed to the charging handle plate at the plate attachment region, and wherein the at least one charging handle and charging handle plate are formed as a single unitary piece comprising the charging handle assembly.

12. The firearm of claim 11, wherein the charging handle assembly further comprises:

a base portion that defines an interior side face;

a first plate portion and a second plate portion, wherein each of the first plate portion and second plate portion extend along a horizontal length of the plate attachment region and extend in an outward direction from the plate attachment region, and wherein the first plate portion defines a top track disposed between the interior side face of the base portion and the first plate portion and the second plate portion defines a bottom track disposed between the interior side face and the second plate portion.

13. The charging handle of claim 12, wherein the top track abuts and slidably engages the top engagement portion of the elongated receiving slot, and wherein the bottom track abuts and slidably engages the bottom engagement portion of the elongated receiving slot.

14. A method of assembling a firearm, the method comprising:

providing a charging handle system, the charging handle system comprising:

a handguard having a first end, a second end, and an elongated handguard bore that extends from the first end to the second end defining a longitudinal length of the handguard, wherein the hand guard further defines an elongated receiving slot having a top engagement portion and a bottom engagement portion;

a charging rod comprising a body having a first end and a second end, and further defining an elongated through-slot that extends from the first end to the second end, wherein the body further defines a charging rod cavity closer to the first end of the charging rod than to the second end of the changing rod;

a charging handle assembly comprising at least one charging handle and at least one charging handle plate coupled to the at least one charging handle, the at least one charging handle plate comprising: a first portion defining a first portion interior surface and a first portion exterior surface; a second portion defining a second portion interior surface and a second portion exterior surface; and a third portion, wherein;

the first portion and second portion are coupled at a first angled abutment;

the second portion extends from the first portion to the third portion, such that the second portion and the third portion are coupled at a second angled abutment; and the second angled abutment comprises an obtuse angle between the second portion and the third portion; and wherein the charging handle assembly defines a top track and a bottom track;

inserting the charging rod into a charging rod slot defined by the elongated handguard bore, such that the first end of the charging rod body is slidably received by the charging rod slot of the elongated handguard bore at the first end of the handguard; and inserting the charging handle assembly into a takedown portion of the elongated receiving slot such that the top track of the charging handle assembly slidably engages the top engagement portion of the elongated receiving slot and the bottom track of the charging handle assembly slidably engages a bottom engagement portion of the elongated receiving slot.

15. The method of claim 14 wherein:

the at least one charging handle comprises at least one lever portion disposed on one of a first side of the handguard and a second side of the handguard.

16. The method of claim 15 further comprising:

aligning the charging handle assembly at the charging handle plate with the charging rod cavity of the charging rod, such that the first portion of the charging handle plate engages the charging rod cavity; and slidably moving the charging handle assembly in a first direction from the takedown portion along the elongated receiving slot;

inserting a bolt carrier group having a front end and a rear end;

wherein the charging rod engages the front end of the bolt carrier group, such that when the charging handle assembly and the charging rod are transitioned between a first position and a second position, the charging rod pushes the front end of the bolt carrier group in the first direction thereby compressing a spring, such that the spring launches the bolt carrier group into a charged position thereby charging the firearm.

17. The method of claim 16, wherein the at least one charging handle comprises a pair of levers, wherein one lever is disposed on the first side of the handguard and another lever is disposed on the second side of the handguard.

18. The method of claim 17, wherein the at least one charging handle is fixed to the charging handle plate, such that the at least one charging handle and charging handle plate are formed as a single unitary piece.

19. The method of claim 17, wherein the at least one charging handle is operatively coupled to the at least one charging handle plate by a plurality of attachment features, such that the at least one charging handle and at least one charging handle plate comprise a two-piece construction.

* * * * *